United States Patent [19]

Touze

[11] 4,210,101

[45] Jul. 1, 1980

[54] HEAT EXCHANGE DEVICES FOR COOLING THE WALL AND REFRACTORY OF A BLAST FURNACE

[76] Inventor: François Touze, Chateau de Logne, 57310 Guenange, France

[21] Appl. No.: 906,210

[22] Filed: May 15, 1978

[30] Foreign Application Priority Data

May 25, 1977 [FR] France ..... 77 15939

[51] Int. Cl.[2] ..... F22B 33/00

[52] U.S. Cl. ..... 122/20 B; 13/32; 165/142; 266/190

[58] Field of Search ..... 432/233, 238; 122/6 B; 266/190; 98/31; 13/32; 165/142

[56] References Cited

U.S. PATENT DOCUMENTS

| | | | |
|---|---|---|---|
| 633,849 | 9/1899 | Johnson | 122/6 B |
| 840,195 | 1/1907 | Berry | 122/6 B |
| 1,031,389 | 7/1912 | Smith | 122/6 B |
| 1,749,395 | 3/1930 | Rice | 122/6 B |
| 2,252,606 | 8/1941 | Wick | 122/6 B |

*Primary Examiner*—Albert W. Davis
*Assistant Examiner*—Margaret A. Focarino
*Attorney, Agent, or Firm*—Larson, Taylor and Hinds

[57] ABSTRACT

The invention concerns heat exchange devices for cooling the wall and the refractory of a blast furnace. Such a device, constituting a cooling box, comprises:

a closed enclosure, elongated and having a shape of revolution or substantially of revolution, this enclosure comprising an outer end and an inner end, an axial chamber defining with said enclosure an annular chamber, this axial chamber comprising an outer end and an inner end, a supply orifice for feeding a cooling liquid into the axial chamber through its outer end.

and a discharge orifice for discharging the cooling liquid from the annular chamber through the outer end of the enclosed enclosure deflector means provided between the inner end of the axial chamber and the inner end of the enclosed enclosure, these deflector means being arranged so as to impart to the whole of the flow of the cooling liquid:

an axial component, directed towards the inner end of the enclosed enclosure, for cooling the central part of the inner end of this enclosure, a radial component for cooling the rest of the inner end of the enclosed enclosure, an axial component directed towards the outer end of the closed enclosure for causing the return of the cooling liquid, and a tangential component for cooling the part of revolution of the closed enclosure.

6 Claims, 7 Drawing Figures

HEAT EXCHANGE DEVICES FOR COOLING THE WALL AND REFRACTORY OF A BLAST FURNACE

The present invention relates to improvements to heat exchange devices for cooling the wall and the refractory of a blast furnace, and more particularly to cooling boxes (intended to be incorporated in the refractory) and cooling plates (for placing between the refractory and the metal casing).

One aim of the invention is to provide heat exchanges while only using a minimum quantity of cooling liquid per unity of time.

Another aim of the invention is to provide such heat exchanges so that the cooling liquid removes, from the wall of the enclosure, a maximum quantity of heat per unity of time.

Another aim of the invention is to minimise the pressure losses during circulation of the liquid in the enclosure.

Another aim of the invention is to provide a heat exchange device which only needs for its manufacture a minimum quantity of material, so that, even if recourse is had to an expensive material, such as copper, the cost of the device remains low.

Finally another aim of the invention is to obtain the highest water speed possible on the parts to be the most intensely cooled, owing to which the heat exchanges at these parts are the highest.

In a first aspect of the invention, which is more particularly applied to cooling boxes, the heat exchange device comprises:

a closed enclosure, elongated and having a form of revolution or substantially of revolution, this enclosure comprising an outer end and an inner end, an axial chamber defining with said enclosure an annular chamber, this axial chamber comprising an outer end and an inner end, a supply orifice for the introduction of a cooling liquid into the axial chamber through its outer end, and a discharge orifice for exhausting the cooling liquid from the annular chamber through the outer end of the closed enclosure.

It is characterised by the fact that: deflector means are provided between the inner end of the axial chamber and the inner end of the enclosed enclosure, these deflector means being arranged so as to impart to the whole of the cooling liquid flow:

an axial component, directed towards the inner end of the closed enclosure, for cooling the central part of the inner end of this enclosure, a radial component for cooling the rest of the inner end of the closed enclosure, an axial component directed towards the outer end of the enclosed enclosure and intended to ensure the return of the cooling liquid, and a tangential component for cooling the part of revolution of the closed enclosure.

With this arrangement, it is ensured that the flow of cooling liquid strikes the inner face of the inner end of the closed enclosure, situated in the hot part of the blast furnace, at a maximum speed and that thereby the cooling takes place with the greatest efficiency.

Furthermore, taking into account the presence of the deflector means, it is ensured that the whole of the internal surface of the inner end of the closed enclosure is bathed by the cooling liquid, then that this liquid, once set in motion in helical rotation through the action of said deflector means, is brought to the outer end of said enclosure while bathing the whole of the wall of this latter without interruption.

Finally, because of the even helical movement imparted to the cooling liquid by the deflector means, it is ensured that the liquid bathes the walls of the enclosure continuously and without swirling movement and that thereby the cooling efficiency obtained is maximum.

In any case, to be certain that the cooling liquid reaches the discharge orifice at a sufficient speed, it is preferable that the tangential component be about ten times greater, at the outlet of the deflector means, than the axial component directed towards the outer end of the enclosure.

According to a preferred embodiment of the invention, the deflector means comprise blades evenly spaced and arranged to create the tangential component from the part of the flow which licks the inner end of the closed enclosure.

According to another aspect of the invention, which applies more particularly to cooling plates, the heat exchange device comprises a closed enclosure having a generally flattened shape (its length being small in relation to its diameter) or substantially of revolution about an axis of revolution, a cooling liquid flowing in said enclosure.

It is characterised by the fact that it comprises furthermore:

injection means for injecting the cooling liquid with a tangential component, situated in a first region of the enclosure, and discharge means, for discharging this liquid tangentially, situated in a second region of the enclosure, said liquid injection and discharge means being spaced respectively radially from each other, said enclosure and said liquid injection and discharge means being so arranged that no point whatever situated inside the enclosure meets an obstacle during rotational movement about the axis of revolution.

It is then advantageous that the means for tangential injection of the liquid emerge in the outer lateral wall of the enclosure and that the means for tangentially discharging the liquid are situated adjacent the centre of the enclosure.

The invention will be better understood with the help of the description which follows of certain of its embodiments, given by way of illustration but in no wise limiting. In this description, reference is made to the accompanying drawings in which.

Although it may be used in very different fields, the cooling device of the invention finds particularly advantageous applications in the field of iron and steel metallurgy and more particularly in blast furnaces in which it is necessary to cool efficiently in particular, on the one hand, the steel plating surrounding on the outside the refractory lining and, on the other hand, the refractory lining itself.

Figure 1:
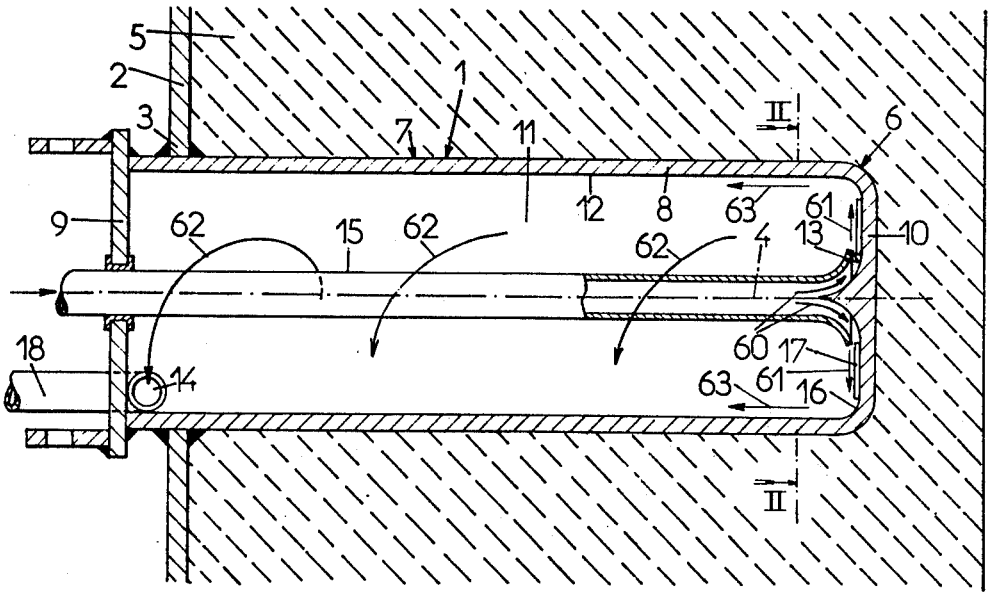
FIG. 1 shows schematically, in section, a first embodiment of the device of the invention relative to a cooling box.

FIG. 1 shows a first embodiment of a cooling device 1 for the plating 2 of a blast furnace, such a device being currently called "cooling box".

As shown in FIG. 1, cooling box 1 corresponding to this embodiment is in the form of an elongated tubular element of revolution.

It passes through the plating 2 of the blast furnace through an opening 3 formed therein and is disposed so that its axis of revolution 4 is substantially horizontal. Over the greatest part of its length, it is thus surrounded by the refractory 5, the nose 6, or end of the box turned towards the inside of the blast furnace and so towards the heat source, being also located in the refractory or on the contrary disengaged, depending on the wear of the refractory.

Box 1 is formed from a good heat conducting material and is capable of withstanding without damage the heat and mechanical stresses: for this purpose, steel, cast iron or copper or an alloy with a high copper content is used. Furthermore the box is fixed to the plating in an appropriate manner, e.g. by welding with or without packing material depending on the nature of the material used for constructing the box.

Box 1 is formed by a closed jacket 7, which comprises:

a cylindrical side wall 8 (as shown in FIG. 1) or slightly in the form of a truncated cone with its conicity turned towards nose 6 (for facilitating the positioning or the removal of the box through the hole 3 in plating 2);

a first end wall 9, situated at the end of the box outside plating 2, this wall 9 being possibly flat, and a second end wall 10, situated on the nose side of the box, which may be flat (as shown in FIG. 1), or bulging.

This jacket 7 defines a closed enclosure 11 in which a cooling liquid is set in motion as will be described further on.

The inner surface 12 of side wall 8 presents no roughness and is perfectly smooth so as to create no turbulence in the liquid in motion.

In box 1, there is provided an orifice 13 for injecting cooling liquid and an orifice 14 for discharging this liquid, these two orifices being located respectively at the two axially opposed ends of the box.

As nose 6 of the box forms the part thereof situated the closest to the heat source, it is very desirable that the cooling liquid is injected at this point. For this purpose, an inlet pipe 15 is provided which sealingly passes through the outer wall 9 of the box and whose orifice 13 is located immediately proximate the inner surface of outer wall 10. For a purpose which will become clear later, pipe 15 is straight and its axis merges with the axis of revolution of jacket 7.

With this arrangement, discharge orifice 14 is situated adjacent end wall 9.

So as to be sure that the cooling liquid continuously licks the inner surfaces of the walls of jacket 7, and more particularly surface 12 of side wall 8, it is provided that the mass of cooling liquid be actuated with a rotational movement about the axis of revolution 4 of jacket 7.

So as not to complicate the manufacture and the maintenance of the device, this setting in rotation of the liquid mass is obtained in a simple way by injecting the liquid through orifice 13 with a tangential speed component.

In this connection, it should be noted that nose 6 is the part of the cooling box which is the most exposed to the heat; it is then through nose 6 that the maximum cooling must be effected. It is then important for the cooling liquid leaving by orifice 13 not only to strike (arrows 60 of FIG. 1) the inner wall of nose 6, consequently in the central region thereof since duct 15 is axial, but also, from this moment on, to be deflected radially (arrows 61 in FIGS. 1 and 2) so that it bathes the whole of the inner wall of nose 6: thereby, the whole of nose 6 of the box participates in the cooling.

In addition, the cooling liquid must be brought back to the first wall 9 and the discharge orifice 14 while effecting a helical movement (arrows 62 in FIG. 1) along the internal face 12 of side wall 8. Thus, the liquid in motion must present two speed components:

an axial component (arrow 63 in FIG. 1) directed towards the first wall 9 and intended to cause the liquid to return to the rear of the box, and a tangential component (arrow 64 in FIG. 2) intended to make the liquid turn along wall 8 so as to cool this latter.

Of course, the above explanation of the breakdown of the movements executed by the mass of liquid leaving orifice 13 is theoretical and, in practice, these movements are intercombined.

To this end, it is provided that the inner surface 16 of outer wall 10 is formed to have hollows or projections 17 constituting blades in the form of spiral sections disposed all around orifice 13 and acting as deflectors for the liquid projected by orifice 13 situated axially opposite, so as to communicate thereto a tangential component.

Thus, from its leaving orifice 13, the stream of liquid strikes the inner face of nose 6 and, from this moment on, is radially deflected by wall 10 (arrow 61) at the same time as it is tangentially deflected by blades 17 (arrow 64).

So that the rotational movement of the liquid mass takes place evenly and without turbulence, it is furthermore desirable that the discharge of the liquid through orifice 14, at the opposite end of the box, also takes place tangentially and that the discharge pipe 18 be suitably disposed in relation to the wall of the jacket. Due to the fact that the inner surface 12 of the wall of jacket 7 is smooth and that the inlet pipe 15 is coaxial to the axis of revolution 4 of the jacket, it is certain that, under the action of the tangential speed component of the liquid injected through orifice 13, the mass of liquid is propelled with an undisturbed rotational movement and that the liquid flows smoothly from nose 10 towards the rear part of the box while continuously licking the wall of jacket 7.

Figure 2:
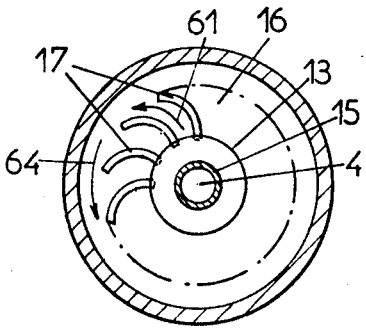
FIG. 2 is a section along line II—II of FIG. 1.
Figure 3:
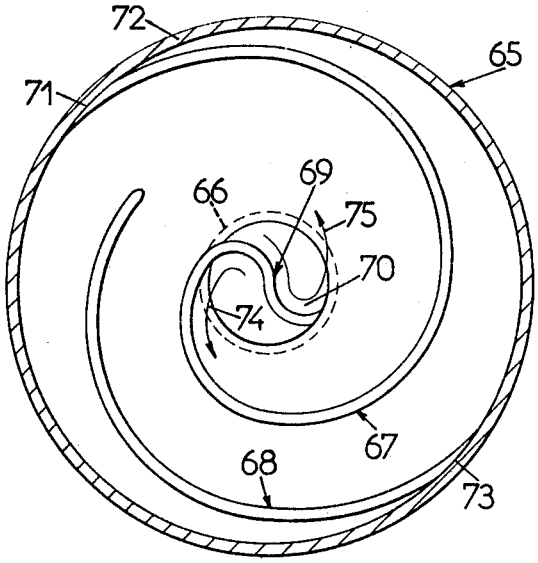
FIG. 3 shows another embodiment of a part of the cooling box of FIG. 1.

FIG. 3 shows another embodiment of the deflector means (seen in the same way—along line II—II—as for FIG. 2), in so far as the junction of the spiral wall 7 with side wall 72 is concerned. Then it is coiled, along a spiral parallel to that described by wall 67, substantially over half-a-turn; it then tangentially rejoins side wall 72 in a zone 73, approximately diametrically opposed to junction zone 71.

When the cooling liquid leaves the orifice 70 of inlet pipe 69, it is divided into two streams by S-shaped region 69. A first part of the liquid is rotated following arrow 74 and flows along wall 67, then between wall 68 and the outer wall 72 of the enclosure. A second part of the liquid is rotated following arrow 75 and flows between walls 67 and 68, then between walls 67 and 72.

Because of the lengths of walls 67 and 68, which are appreciably greater than those of blades 17 of the cooling box of FIGS. 1 and 2, the liquid can be more evenly set in rotation, the liquid being guided for a longer period of time.

In order to improve the effect obtained, S-shaped region 69 of wall 67 can be made to penetrate a little inside pipe 66, thus the liquid is divided into two streams and its rotation may be initiated a little before it leaves through orifice 70.

Futhermore, so as to extend the guiding of the streams of liquid, walls 67 and 68 may be extended for a short distance.

In the cooling box 65 of FIG. 3, pipe 66 bringing cooling liquid has a diameter a little greater than that of pipe 15 of the box of FIGS. 1 and 2.

In box 65, the deflector means are formed by two projecting walls, respectively 67 and 68, forming respectively arcs of two spirals wound one in the other. Similarly, in the preceding example, these two projecting walls are carried by the internal face of the nose of the cooling box.

As shown in FIG. 3, wall 67 comprises a central part 69, i.e. located in the zone of low curvature of the spiral, disposed across orifice 70 of pipe 66; this central part 69 presents two regions, of substantially equivalent lengths, having opposite curvature, i.e. the central part 69 has the general shape of an S.

Beyond central part 69 (towards the left in FIG. 3), the projecting wall 67 develops along a spiral, with a continuously increasing radius of curvature, substantially over a complete turn. At this point it joins again at 71 side wall 72 of box 65.

As for the other projecting wall 68, it is initiated substantially on the radius joining the axis of revolution of the enclosure to zone 71 along the side wall 72 of box 65, so as to cancel out the disturbances sustained by the streams of liquid at the time of their change of path guiding plane, between the internal face of the nose and the internal face of side wall 72.

Of course, the deflector means may just as well be carried by the end of the inlet pipe situated around the liquid injection orifice.

Figure 5:
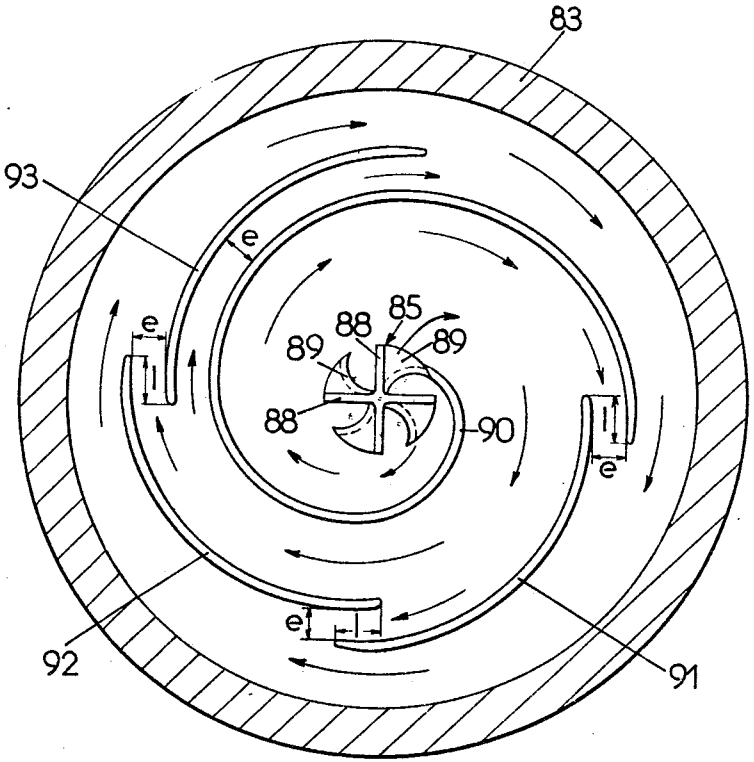
FIGS. 4 and 5 show, respectively in a side view and end view, yet another embodiment of a cooling box of the same type as that of FIG. 1.
Figure 4:
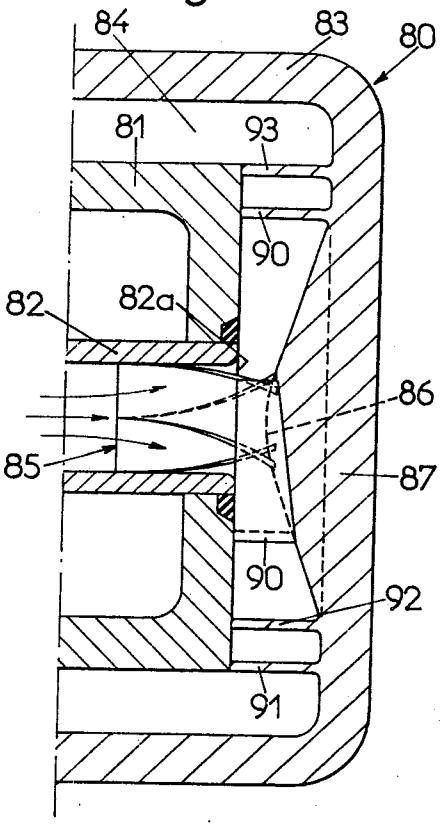

FIGS. 4 and 5 show a combination in which a part of the deflector means is carried by the end of the liquid inlet pipe (creating a primary rotation) whereas another part of the deflector means is carried by the internal face of the nose of the cooling box (and completes the setting of the liquid in rotation).

As shown in FIGS. 4 and 5, cooling box 80, which may be formed as a whole like box 1 of FIG. 1, is provided with an annular jacket 81 surrounding liquid inlet pipe 82, and defining with the outer jacket 83 an annular chamber 84 in which the cooling liquid is intended to flow helically in the form of a relatively thin layer and at high speed.

Towards its outlet **82*a*, liquid inlet pipe 82 is provided with a deflector 85 partially engaged in the pipe and disposed end to end with the inner face 86 of nose 87** of the box.

Deflecting member 85, in cross-section, is in the form of a four-legged cross-piece 88, each leg 88 being axially curved so as to form a deflecting trough 89.

Deflecting member 85 is an insert in the end of pipe 82.

Moreover, the inner face 86 of nose 87 of the box is not flat, but is substantially in the shape of a truncated cone with a central part in the shape of a spherical skull-cap, the whole forming a proeminence turned inwardly of the enclosure. Furthermore, this inner face 86 carries deflecting walls in the shape of arcs of a spiral, projecting parallel to the axis of revolution of the enclosure A first wall 90 is situated opposite one of the deflecting troughs 89 of deflector member 85 and develops, with a curvature identical at the start to that of the trough, along an arc of a spiral for approximately a complete turn, the radius of curvature increasing continuously.

A second wall 91 starts substantially at the free end of the first wall 90, while being located inwardly of the spiral described by wall 90 at a distance e therefrom. Furthermore, walls 90 and 91 face each other over a curvilinear length 1. Wall 91 develops in its turn along an arc of a spiral approximately over a quarter of a turn.

A third wall 92, beginning at a distance e from wall 91 and situated opposite thereto over a length 1, develops along an arc of a spiral approximately for a quarter of a turn.

Finally a fourth wall, situated at distance e from wall 92 and also from wall 90, extends over an arc of a spiral for approximately a quarter of a turn parallel to wall 90.

In addition, as can be best seen in FIG. 4, the free edges of deflector walls 90 to 93 are coplanar and the front end of annular jacket 81, which is also flat, is disposed end to end against the free edges of deflector walls 90 to 93. Thus there is defined an assembly of spiral passages of variable and decreasing widths (taken in the direction of flow of the liquid) intercommunicating through necks of lengths l and widths e.

With this arrangement, the cooling liquid brought by pipe 82 begins to be set in rotation by deflector 85 with troughs 89, already before it leaves through orifice **82*a* of said pipe. At this moment, the rotational movement continues to be communicated to the liquid by deflector walls 90 to 93**.

Because of the relative positions of said walls 90 to 93, the liquid is caused to pass through a neck of width e, and this whatever the path followed. Because of the relative narrowness of these necks, the liquid is accelerated during its passage therethrough, which ensures that the cooling liquid will begin to follow a helical path, in annular chamber 84, with a tangential speed component sufficiently high for it to reach the other end of the cooling box at a tangential speed allowing its discharge by simple inertia. Experiments have shown that, in order that this result may be obtained, it is advaisable for the tangential component to be about ten times greater than the axial component directed towards the opposite end of the enclosure.

Of course the cooling box which has just been described may be designed differently.

A one piece independent part may be formed, obtained for example by moulding, comprising on one side deflector 85 and on the other deflector walls 90 to 93, this independent part being fitted into the end of pipe 82 and disposed end to end against the inner face of nose 87 of the cooling box.

A deflector member 85 may also be formed by moulding to form a single piece with nose 87 of the cooling box, and with deflector walls 90 to 93; under these conditions, part 85 fits into the end of pipe 82 when this latter is positioned and contributes to facilitating its positioning.

Figure 7:
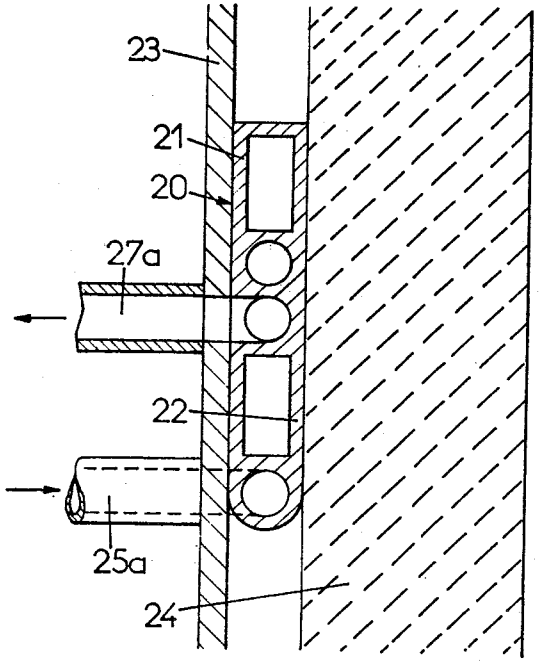
FIGS. 6 and 7 show, in section, respectively in a side view and a top view, another cooling device in accordance with the invention.
Figure 6:
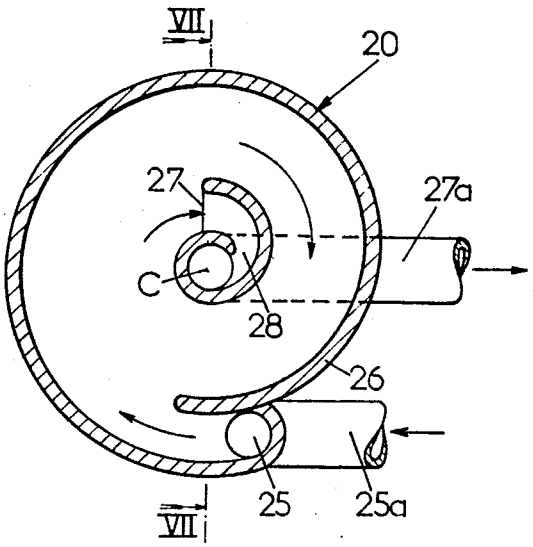

Referring to FIGS. 6 and 7, there will now be described another embodiment in accordance with the invention, which corresponds again to the case of a box for cooling the plating of a blast furnace.

It is however a question here of a box having a flattened shape, which, in the technique is called "cooling plate" and this terminology will be adopted in the continuation of the description.

Such plates are not disposed in the refractory like the elongated type boxes previously described, but between the refractory and the internal face of the plating so as to form a continuous or discontinuous thermal screen, depending on the gap left between two consecutive plates between the heat source and the plating.

These plates are, like the elongated boxes, made from a heat conducting and mechanically resistant material, such as steel, cast iron or copper.

Referring to FIGS. 6 and 7 in which is shown a plate 20 in accordance with the invention, this plate has a flattened shape, its parallel faces 21 and 22 being respectively in contact with plating 23 and the refractory 24, and it is hollow to allow the cooling liquid to flow.

Parallel faces 21 and 22 are round. An injection orifice 25 emerges in the plate tangentially to the substantially cylindrical side wall 26.

A discharge orifice 27 opens tangentially adjacent the centre of the plate, and the discharge pipe 28 coils towards the centre of the plate and is bent so as to leave the plate through a lateral face in the centre thereof. Liquid inlet 25*a* and discharge 27*a* pipes are disposed substantially perpendicularly to the plate.

The plate assembly has then the general aspect of a snail shell.

It will be noted that the axes of the injection 25 and discharge 27 orifices are respectively at distances R and r from the centre C of the box. For this reason, so that the inlet and outlet flows of liquid may be equal, it is necessary for the section S of the discharge orifices to be greater than the section s of the injection orifice.

The equality of flows produces as a consequence:

$$V_1 \cdot s = V_2 \cdot S,$$

$V_1$ and $V_2$ designating the inlet and outlet speeds which are in the ratio of distances R and r, i.e.

$$(V_1/R) = (V_2/r)$$

The following geometrical condition must then be achieved $$R/r = S/s$$

Similarly, as in the case of the elongated box of FIG. 1, it is necessary for the internal walls of the plate to present no roughness so as not to create turbulences within the mass of liquid in motion.

During operation, because of the tangential injection of the liquid through orifice 25, the liquid mass is propelled with a rotational movement and evenly licks each point of the walls of the plate. It can be considered that the stream of liquid, introduced through orifice 25, coils round within the inner volume of the plate before reaching discharge orifice 27.

With the setting in rotation of the mass of cooling liquid, with the help of suitable deflector means, and by disposing the injection and discharge orifices for the liquid in opposite regions of the device, it is ensured that each zone of the wall to be cooled is licked by the liquid and is thus efficiently cooled.

By arranging for the walls not to have any roughness and for nothing to oppose the rotational motion of the liquid mass, this latter is the seat of no turbulence and all the zones of the wall to be cooled, whichever they are and wherever they are located, are cooled in the same manner and with the same efficiency. Furthermore, pressure losses in the hydraulic circuit are practically eliminated.

It is thus possible to calculate very accurately the minimum flow of liquid to be injected into the enclosure to obtain a predetermined cooling and so to achieve substantial economies on the amount of liquid necessary and, consequently, on the cost price of the cooling.

The flow of the liquid can also be accurately calculated so that it heats up to the maximum, this heating up going possibly far enough to cause vaporization, which allows the efficiency of the device to be further increased due to the fact that the vapours, while escaping, help in the movement of the remaining liquid mass.

The geometrical shape of the component parts of the device is simplified, which reduces the amounts of material necessary and the manufacturing costs and so the overall cost price of the device. Thus, manufacturing of the device from steel, cast iron or copper may be considered.

It is possible to mount several cooling devices in accordance with the invention by intercoupling them; thus it is that there can be provided intercoupling of several elongated cooling boxes, coupling between a cooling box surrounding this box, intercoupling between several cooling plates.

As is evident and as it follows moreover already from what has gone before, the invention is in no wise limited to those of its modes of application and embodiments which have been more particularly considered; it embraces, on the contrary, all variations thereof.

I claim:

1. a heat exchange device for cooling the wall and the refractory of a blast furnace, comprising:

a closed enclosure, elongated and having a shape of revolution or substantially of revolution, this enclosure comprising an outer end and an inner end, an axial chamber defining with said enclosure an annular chamber, this axial chamber comprising an outer end and an inner end, a supply orifice for feeding a cooling liquid into the axial chamber through its outer end, and a discharge orifice for discharging the cooling liquid from the annular chamber through the outer end of the enclosed enclosure, deflector means provided between the inner end of the axial chamber and the inner end of the enclosed enclosure, these deflector means being arranged so as to impart to the whole of the flow of the cooling liquid:

an axial component, directed towards the inner end of the enclosed enclosure, for cooling the central part of the inner end of this enclosure, a radial component for cooling the rest of the inner end of the enclosed enclosure, an axial component directed towards the outer end of the closed enclosure for causing the return of the cooling liquid, and a tangential component for cooling the part of revolution of the closed enclosure.

2. A heat exchange device according to claim 1, wherein the tangential component is about ten times greater, at the outlet of the deflector means, than the axial component directed towards the outer end of the enclosure.

3. A heat exchange device according to claim 1, wherein the deflector means comprise blades evenly spaced and arranged so as to create the tangential component from the part of the flow which licks the inner end of the enclosed enclosure.

4. A heat exchange device according to claim 3, wherein the blades extend into the annular chamber.

5. A heat exchange device according to claim 4, wherein the blades are carried by the inner end of the enclosure.

6. A heat exchange device according to claim 4, wherein the blades are carried by the inner end of the axial chamber.

* * * * *